US008011960B2

(12) United States Patent
Xiao et al.

(10) Patent No.: US 8,011,960 B2
(45) Date of Patent: Sep. 6, 2011

(54) ELECTRICAL CONNECTOR ASSEMBLY WITH ASSEMBLED MAIN SHELL AND SUB-SHELL

(75) Inventors: Jian-Ping Xiao, ShenZhen (CN); Tsuneki Watanabe, Yokohama (JP)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 1 day.

(21) Appl. No.: 12/611,120

(22) Filed: Nov. 3, 2009

(65) Prior Publication Data

US 2010/0112863 A1 May 6, 2010

(30) Foreign Application Priority Data

Nov. 3, 2008 (CN) ..... 2008 2 0302632

(51) Int. Cl.
*H01R 13/648* (2006.01)

(52) U.S. Cl. ..... 439/607.56; 439/607.48; 439/607.24

(58) Field of Classification Search .. 39/607.23–607.25, 39/607.41–607.52, 607.54, 607.55–607.57
See application file for complete search history.

(56) References Cited

U.S. PATENT DOCUMENTS

| | | | | |
|---|---|---|---|---|
| 6,383,024 | B1 * | 5/2002 | Wang et al. | 439/607.23 |
| 7,845,965 | B2 * | 12/2010 | Ko | 439/352 |
| 7,850,477 | B2 * | 12/2010 | Koyama et al. | 439/358 |
| 2002/0048992 | A1 * | 4/2002 | Wang et al. | 439/607 |
| 2004/0127099 | A1 * | 7/2004 | Lin et al. | 439/610 |
| 2007/0155243 | A1 * | 7/2007 | Watanabe et al. | 439/610 |
| 2010/0062653 | A1 * | 3/2010 | Mao et al. | 439/660 |
| 2010/0112863 | A1 * | 5/2010 | Xiao et al. | 439/607.27 |

* cited by examiner

*Primary Examiner* — Ross N Gushi
(74) *Attorney, Agent, or Firm* — Wei Te Chung; Andrew C. Cheng; Ming Chieh Chang

(57) ABSTRACT

An electrical connector assembly (100) comprises an insulative body (1) integrally including a forward part (12) and a backward part (11). A main shell (32) includes a front pocket (320) enclosing the forward part (12), and a back segment (322) covering an upper portion of the backward part (11) of the body (1). A sub-shell (31) is assembled with the main shell (32), and includes a lower piece (316) covering a lower portion of the backward part (11). Therefore, the main shell (32), the sub-shell (31) are assembled with each other to provide a good shielding enclosure for the insulative body (1), where the contact terminals (2) are held therein.

11 Claims, 6 Drawing Sheets

ELECTRICAL CONNECTOR ASSEMBLY WITH ASSEMBLED MAIN SHELL AND SUB-SHELL

BACKGROUND OF THE INVENTION

1. Field of the Invention

The present invention relates to the art of electrical connectors, and more particularly to an electrical connector assembly equipped with a main shell and a sub-shell for shielding the electrical connector assembly.

2. Description of the Related Art

Recently, personal computers (PC) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method. Further, with the trend of miniaturization, micro USB connectors have been popular. However, the shielding system for the micro USB connector is designed differently so as to mate with the micro USB connector.

SUMMARY OF THE INVENTION

An electrical connector assembly comprises an insulative body integrally including a forward part and a backward part. The forward part is split into a short tongue and a large tongue disposed in a common plane. The backward part has a pair of side tabs on opposite sidewalls thereof. A plurality of contact terminals is held by the insulative body with contact portions exposed upon the short tongue and the large tongue, and mounting portions exposed upon a back wall of the backward part. A main shell, made of metal material, integrally includes a front pocket and a back segment. The front pocket has two different parts substantially enclosing the short tongue and the large tongue. The back segment includes an upper piece covering an upper portion of the backward part of the insulative body, and a pair of side pieces. The side pieces respectively have a pair of first slots engaging with the side tabs of the backward part of the insulative body to assemble the body with the main shell. A sub-shell, made of metal material, is assembled with the main shell. The sub-shell includes a pair of second slots located outside of the first slots of the main shell for engaging with the side tabs of the backward part, and a lower piece covering a lower portion of the backward part of the insulative body. Therefore, the main shell, the sub-shell are assembled with each other to provide a good shielding enclosure for the insulative body, where the contact terminals are held therein.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
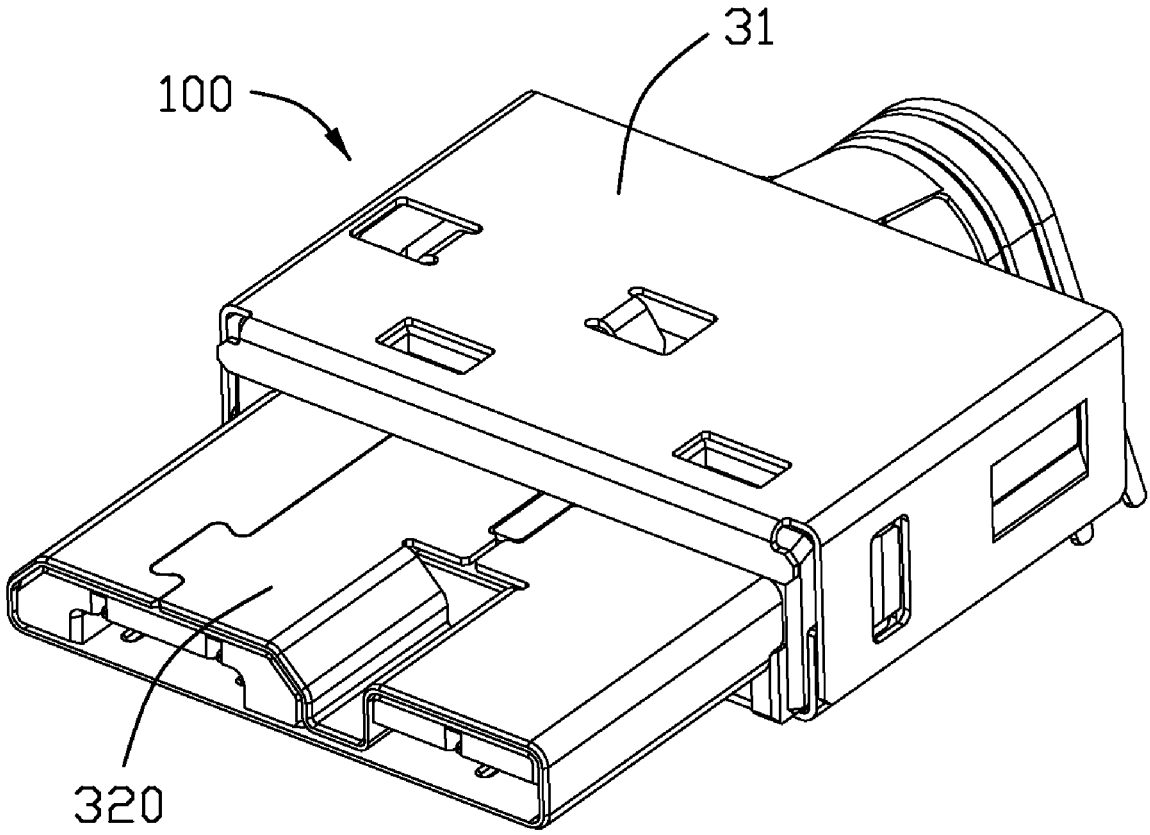
FIG. 1 is an assembled, perspective view of an electrical connector assembly according to an embodiment of the present invention.
Figure 2:
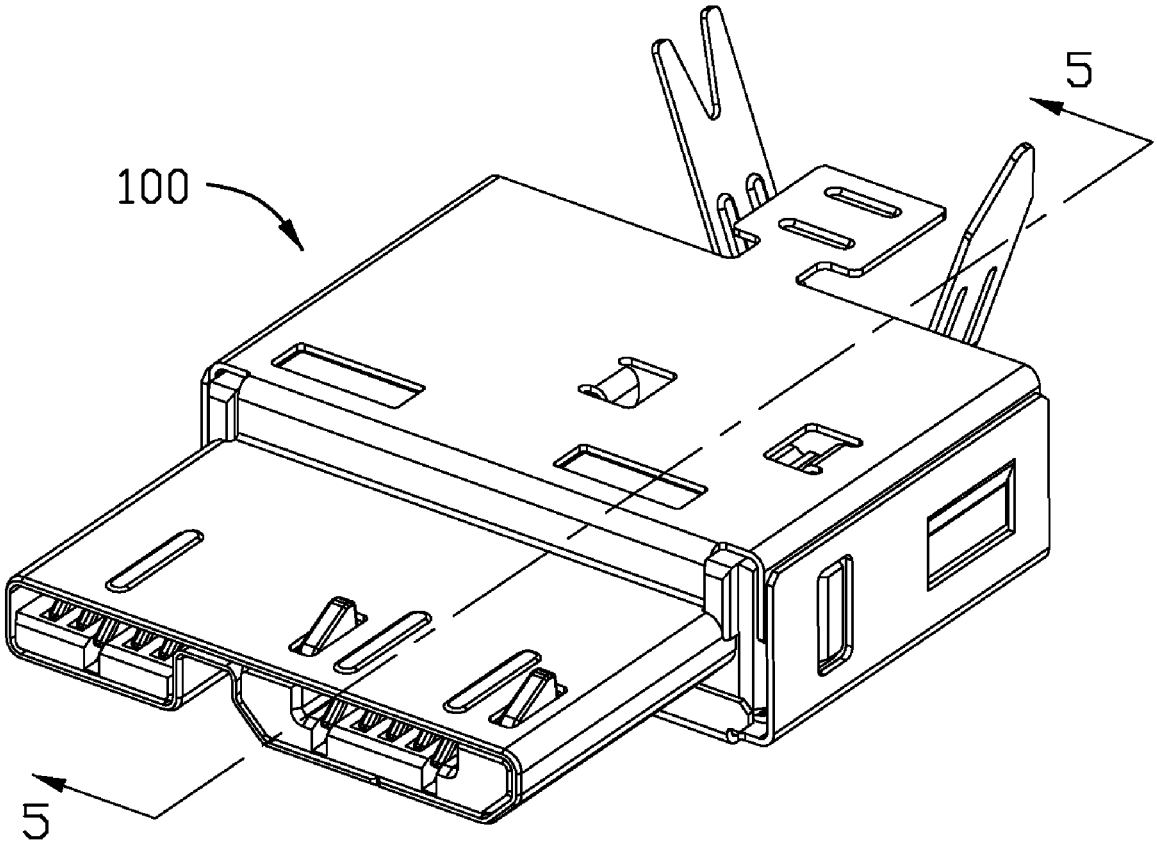
FIG. 2 is an assembled, perspective view of the electrical connector assembly of FIG. 1, viewed from another aspect.
Figure 3:
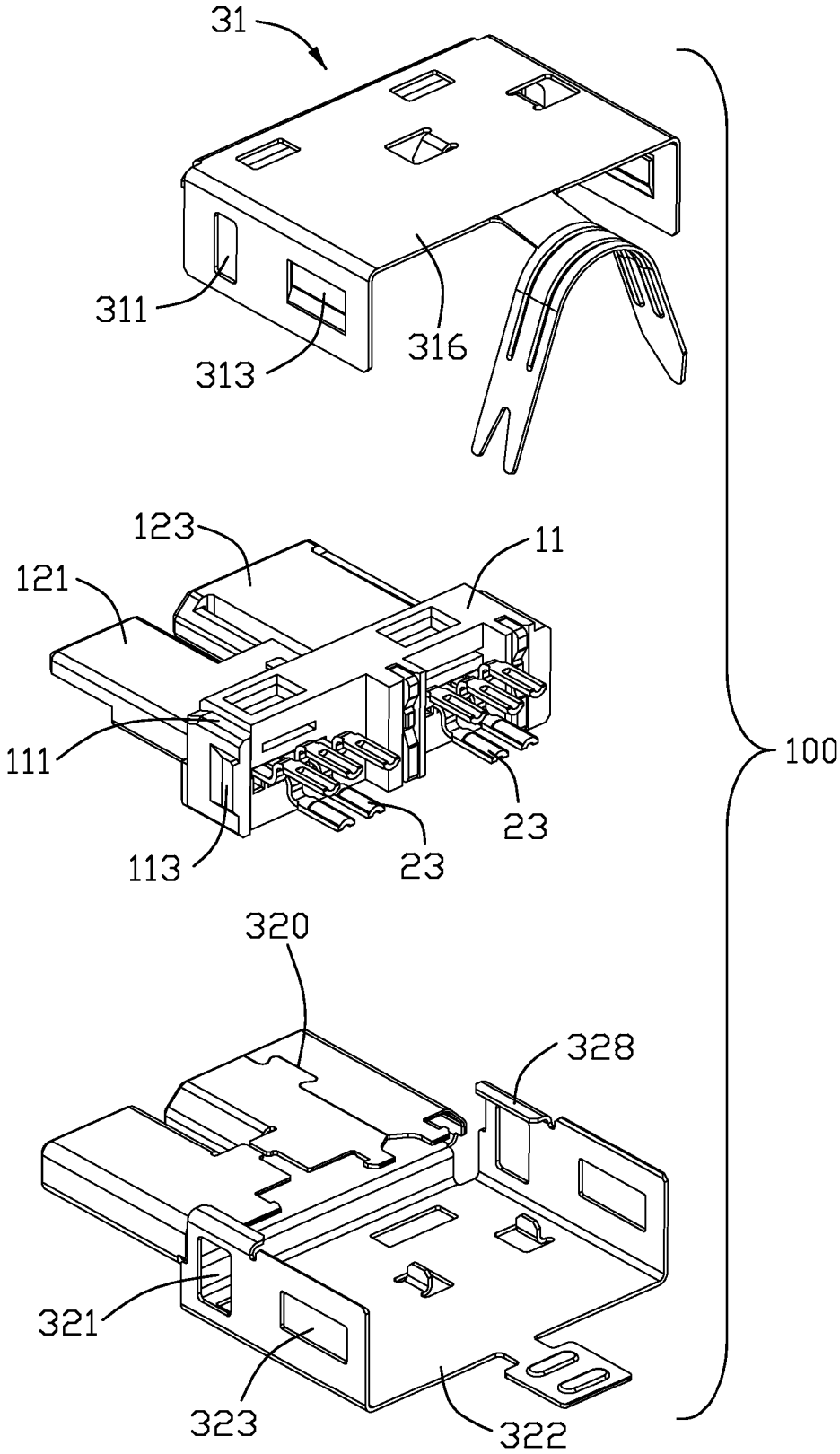
FIG. 3 is a partly-exploded, perspective view of the electrical connector assembly of FIG. 1.
Figure 4:
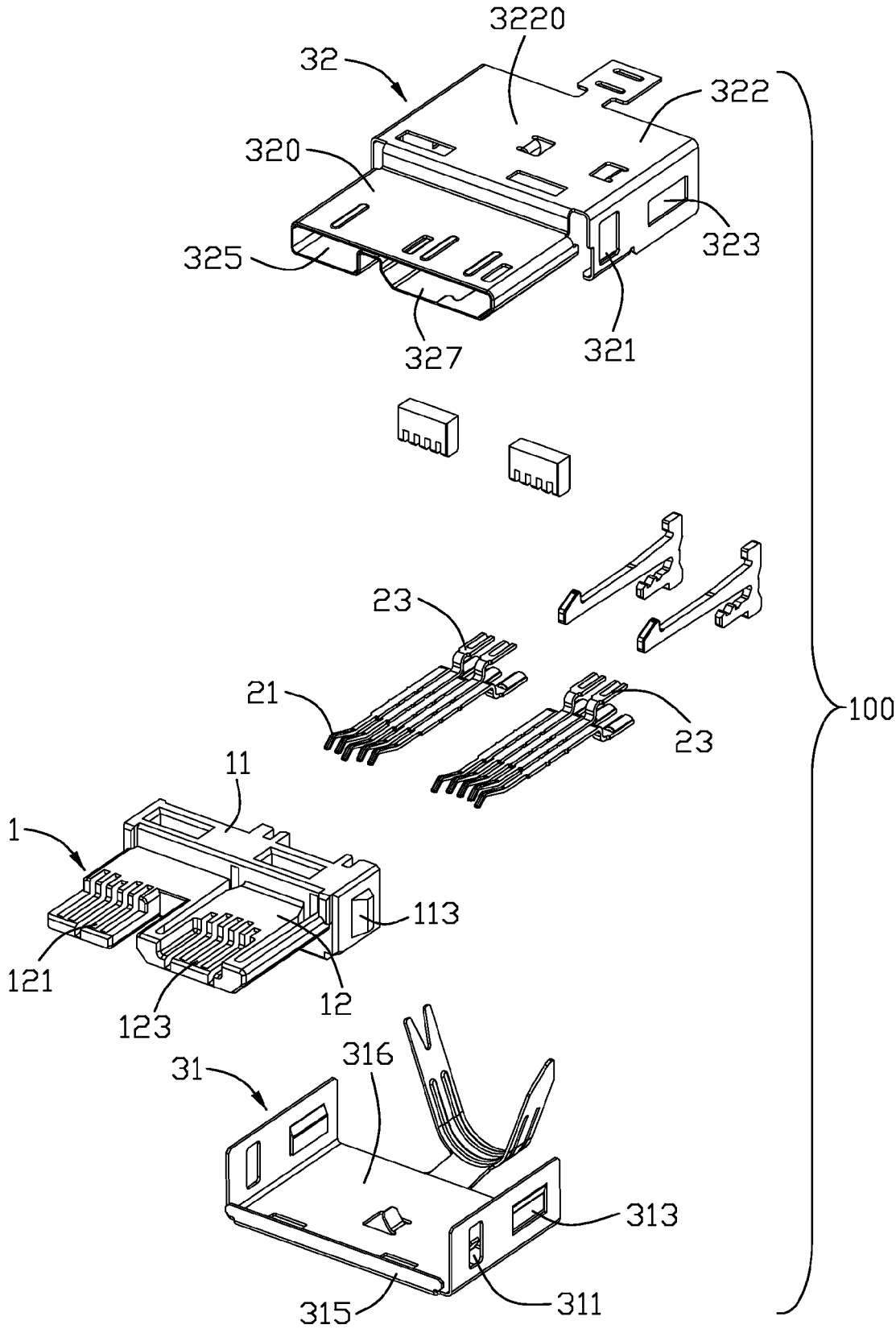
FIG. 4 is an exploded, perspective view of the electrical connector assembly of FIG. 1, viewed from another aspect.
Figure 5:
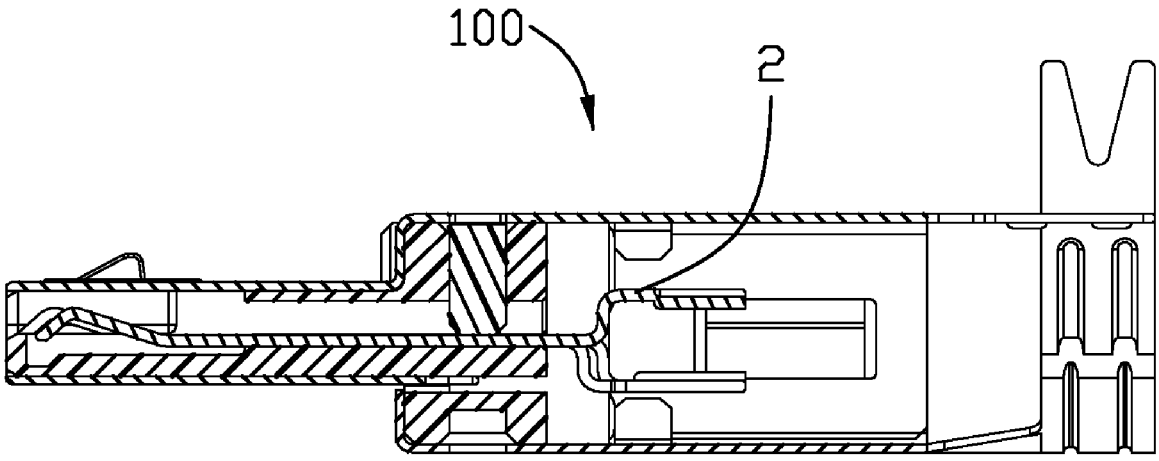
FIG. 5 is a cross sectional view of the electrical connector assembly of FIG. 2, taken along line 5-5 thereof.
Figure 6:
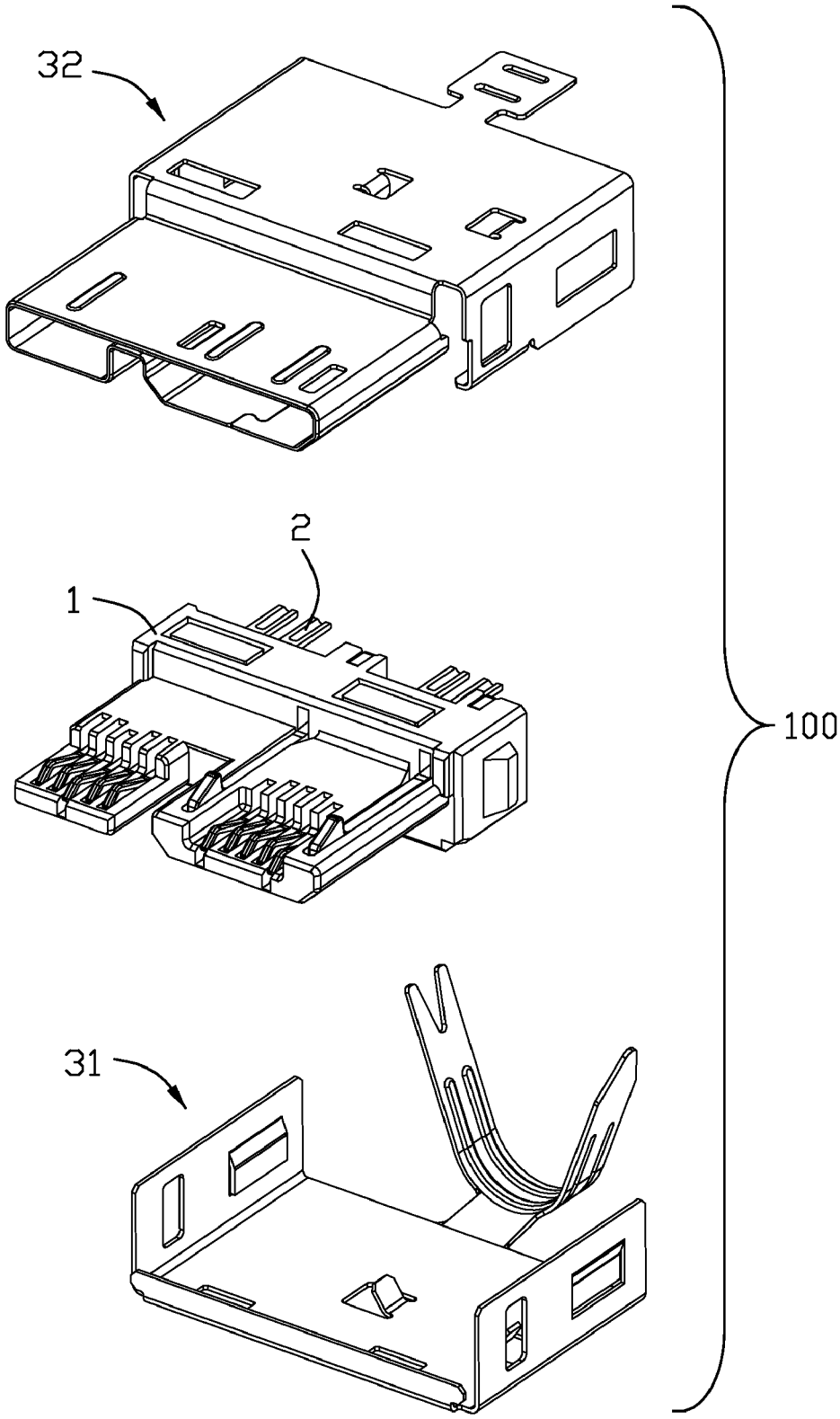
FIG. 6 is a partly-exploded, perspective view of the electrical connector assembly of FIG. 1, viewed from another aspect.

Referring to FIGS. 1 to 6, an electrical connector assembly 100 includes an insulative body 1 with a plurality of contact terminals 2 held therein, a main shell 32 and a sub-shell 31 in cooperation with the main shell 32 to shield the insulative body 1.

The insulative body 1 integrally includes a backward part 11 and a forward part 12 extending forwardly from the backward part 11. The forward part 12 is split into a short tongue 121 and a large tongue 123 disposed in a common plane. That is, the short tongue 121 and the large tongue 123 are spaced with a distance at a front end of the forward part 12. Each of the short tongue 121 and the large tongue 123 has a mating face. The contact terminals 2 are disposed on the mating face with resilient contact portions 21 exposed upon the mating face, and mounting portions or surface mounted legs 23 extending out of a back wall of the backward part 11. The backward part 11 has a pair of side tabs 113 on opposite sidewalls for first slots 321 of the main shell 32 to be firstly engaged therewith, and then for second slots 311 of the sub-shells 31, located outside of the first slots 321 of the main shell 32, to be engaged therewith. Thus, the insulative body 1, the main shell 32 and the sub-shell 31 are assembled as a unit. Each of side tabs 113 has upper and lower horizontal faces to restrict the vertical movement of the main shell 32 relative to the sub-shell 31.

The main shell 32, made of metal material, integrally includes a front pocket 320 and a back segment 322. The front pocket 320 has two different parts 325 and 327 physically divided by punching a portion of a first wall to enable the first wall more proximate to an opposite second wall so as to enclose the short tongue 121 and the large tongue 123, where the contact terminals 2 are held therewith. This configuration of the front pocket 320 is regarded as a micro USB interface, which is defined by the standard. The back segment 322 includes an upper piece 3220 covering an upper portion of the backward part 11 of the insulative body 1, a pair of side pieces, and a pair of lower wings 328 extending from the respective side pieces and parallel to the upper piece 3220. The pair of lower wings 328 engages with a stepped slot 111 of the insulative body 1 to assist the assembly of the insulative body 1 and the main shell 32. The side pieces include a pair of first slots 321 each extending in a vertical direction, and a pair of through holes 323 each extending in a horizontal direction.

The sub-shell 31, made of metal material, is assembled with the main shell 32 by a pair of second slots 311 of the sub-shell 31, located outside of the first slots 321 of the main shell 32, to cooperate with the first vertical slots 321 of the main shell 32 to commonly engage with the side tabs 113 of the backward part 11 so as to hold the main shell 32, the sub-shell 31 and the insulative body 1 in position in the vertical direction. The sub-shell 31 has a pair of spring tabs 313 extending in the horizontal direction to resiliently engage with the horizontal through holes 323 to hold the main shell 32 and the sub-shell 31 in position in the horizontal direction. Thus, the main shell 32, the sub-shell 31 and the insulative body 1 are held in position by combination of the horizontal position and the vertical position. The sub-shell 31 includes a lower piece 316 covering a lower portion of the backward part 11 of the insulative body 1. Thus, the backward part 11 of the insulative body 1, where the surface mounted legs 23 are located, are enclosed by the cooperation of the main shell 32 and the sub-shell 31. Further, the sub-shell 31 includes a front edge section 315 extending toward the front pocket 320 to abut against the front pocket 320 of the main shell 32 to assist in the shield for where two discrete parts are assembled. Therefore, the main shell 32, the sub-shell 31 are assembled with each other to provide a good shielding enclosure for the insulative body 1, where the contact terminals 2 are held therein.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector assembly, comprising:

an insulative body integrally including a forward part and a backward part, said forward part split into a short tongue and a large tongue disposed in a common plane, the backward part having a pair of side tabs on opposite sidewalls thereof;

a plurality of contact terminals held by the insulative body with contact portions exposed upon the short tongue and the large tongue, and mounting portions exposed upon a back wall of the backward part;

a main shell, made of metal material, integrally including a front pocket and a back segment, the front pocket having two different parts substantially enclosing said short tongue and said large tongue, the back segment including an upper piece covering an upper portion of said backward part of the insulative body, and a pair of side pieces, the side pieces respectively having a pair of first slots engaging with the side tabs of the backward part of the insulative body to assemble the body with the main shell, a sub-shell, made of metal material, assembled with the main shell, the sub-shell including a pair of second slots located outside of the first slots of the main shell for engaging with the side tabs of the backward part, and a lower piece covering a lower portion of said backward part of the insulative body.

2. The electrical connector assembly as recited in claim 1, wherein the sub-shell includes a front edge section extending toward the front pocket to abut against the front pocket of the main shell.

3. An electrical connector assembly, comprising:

an insulative base including a back part and a forward tongue extending forwardly from the back part, the back part having a pair of side tabs on opposite sidewalls thereof;

a plurality of contact terminals held by the insulative base with contact portions exposed upon the forward tongue, and mounting portions exposed upon a back wall of the back part;

a main shell made of metal material, the main shell integrally including a front pocket enclosing the forward tongue, an upper cover covering an upper portion of the back part, a pair of side pieces, a pair of lower wings extending from the respective side pieces and parallel to the upper piece, each of the pair of lower wings engaging with a stepped slot of the insulative body to assist an assembly of the insulative body and the main shell;

a sub-shell made of metal material and including a lower cover covering a lower portion of the back part;

wherein the main shell and the sub-shell includes first slots and second slots extending in a vertical direction to engage with the side tabs of the insulative base to hold the main shell, the sub-shell and the insulative base in position in the vertical direction; and wherein the main shell includes third slots extending in a horizontal direction and the sub-shell includes spring wings extending in the horizontal direction to engage with the third slots to hold the main shell and the sub-shell in position in the horizontal direction perpendicular to the vertical direction.

4. An electrical connector assembly comprising:

an insulative housing including a thick back part and a thin forward part extending forwardly from a front portion of the back part;

the forward part defining a large tongue and a small tongue side by side arranged with each other under condition that front portions of said large tongue and said small tongue are laterally separated/split from each other while rear portions of said large tongue and said small tongue are united with each other;

first and second sets of contacts respectively located in the corresponding large tongue and the small tongue;

a metallic shell including a front pocket and a rear segment, said front pocket essentially fully encloses the whole forward part and the rear segment essentially covering the back part; and the front pocket essentially defining juxtaposed circumferentially enclosed large and small receiving cavities with a non-circumferentially enclosed notch structure therebetween under condition that the large receiving cavity encloses the large tongue and the small receiving cavity encloses the small tongue; wherein said notch structure is essentially located in a space defined between the split front portions of the large tongue and the small tongue.

5. The electrical connector assembly as claimed in claim 4, wherein said notch structure rearwardly terminates at a boundary of said front portions and the rear portions of the large tongue and the small tongue.

6. The electrical connector assembly as claimed in claim 4, wherein the notch structure is essentially of laterally unitarily linking to neighboring regions of the shell while the front pocket behind the notch structure is not of a unitary form but being split from each other while sharing with a common edge.

7. The electrical connector assembly as claimed in claim 6, wherein said front portions pocket essentially extends in a coplanar manner to cover the whole forward part in a front-to-back direction disregarding the front portions or the rear portions of said large tongue and the small tongue.

8. The electrical connector assembly as claimed in claim 7, wherein the front pocket around the large receiving cavity defines a boundary edge shared by two parts by two sides.

9. The electrical connector assembly as claimed in claim 4, wherein the large tongue is equipped with a pair of raised platforms with a pair of latches movable therein, respectively.

10. The electrical connector assembly as claimed in claim 4, wherein the front pocket around the large tongue defines a pair of through holes.

11. The electrical connector assembly as claimed in claim 4, wherein shell is of a unitary one piece.

* * * * *